US007744661B2

(12) United States Patent
Braakman et al.

(10) Patent No.: US 7,744,661 B2
(45) Date of Patent: Jun. 29, 2010

(54) FUEL COMPOSITION CONTAINING AN ALKYLENE OXIDE-ADDUCTED HYDROCARBYL AMIDE HAVING REDUCED AMINE BY-PRODUCTS

(75) Inventors: Bernard J. Braakman, Kensington, CA (US); Richard E. Cherpeck, Cotati, CA (US); Brian R. Graskow, Danville, CA (US); Francois Simard, Novato, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 1440 days.

(21) Appl. No.: 11/129,163

(22) Filed: May 13, 2005

(65) Prior Publication Data

US 2006/0254129 A1 Nov. 16, 2006

(51) Int. Cl.
*C10L 1/224* (2006.01)

(52) U.S. Cl. ..... 44/418; 44/400; 44/434

(58) Field of Classification Search ..... 44/418
See application file for complete search history.

(56) References Cited

U.S. PATENT DOCUMENTS

| | | | | |
|---|---|---|---|---|
| 4,297,107 | A | 10/1981 | Boehmke | |
| 4,729,769 | A * | 3/1988 | Schlicht et al. | 44/418 |
| 6,312,481 | B1 | 11/2001 | Lin et al. | |
| 2001/0034308 | A1 | 10/2001 | Krull et al. | |
| 2003/0046861 | A1 * | 3/2003 | Ohta et al. | 44/418 |
| 2006/0107584 | A1 * | 5/2006 | Simard et al. | 44/418 |

FOREIGN PATENT DOCUMENTS

| | | | |
|---|---|---|---|
| EP | 1 273 652 | A1 | 8/2003 |
| EP | 1 431 374 | A1 | 6/2004 |
| EP | 1 435 385 | A1 | 7/2004 |
| EP | 1435385 | A1 * | 7/2004 |
| EP | 1 688 414 | A2 | 9/2006 |
| WO | WO 9219587 | A1 * | 11/1992 |

* cited by examiner

*Primary Examiner*—Ellen M McAvoy
*Assistant Examiner*—Ming Cheung Po
(74) *Attorney, Agent, or Firm*—Claude J. Caroli; M. Carmen & Associates, PLLC

(57) ABSTRACT

A fuel composition comprising a major amount of hydrocarbons boiling in the gasoline or diesel range and an alkylene oxide-adducted hydrocarbyl amide reaction product having from about 3 to 50 moles of alkylene oxide per mole of hydrocarbyl amide, wherein the reaction product is prepared by (a) first reacting a fatty acid or fatty acid lower alkyl ester with ammonia or a mono- or di-hydroxy hydrocarbyl amine and (b) subsequently reacting the resulting intermediate with an alkylene oxide to provide a reaction product comprising the alkylene oxide-adducted hydrocarbyl amide, a mixture of mono- and di-ester products, and amine by-products, wherein the amount of amine by-products in the reaction product is less than 7 wt %, based on the total weight of the alkylene oxide-adducted hydrocarbyl amide reaction product, and the amide:ester ratio in the reaction product is in the range of about 0.1:1 to 1.1:1.

35 Claims, No Drawings

FUEL COMPOSITION CONTAINING AN ALKYLENE OXIDE-ADDUCTED HYDROCARBYL AMIDE HAVING REDUCED AMINE BY-PRODUCTS

This invention relates to a fuel composition. More particularly, this invention involves a fuel composition containing a major amount of hydrocarbons boiling in the gasoline or diesel range and an alkylene oxide-adducted hydrocarbyl amide reaction product.

BACKGROUND OF THE INVENTION

Alkylene oxide-adducted hydrocarbyl amides have efficacious detergency properties. Their usefulness in hydrocarbon fuels, e.g. fuels in the gasoline or diesel boiling range, is known for preventing deposits in internal combustion engines, controlling octane requirement increases and reducing octane requirement. In addition, the combustion is improved through the use of certain of these compounds. The driveability of vehicles is believed to be enhanced when using fuels containing alkylene oxide-adducted hydrocarbyl amides.

U.S. Pat. No. 4,297,107 to Boehmke, issued on Oct. 27, 1981, discloses a fuel comprising a hydrocarbon, water and an emulsifier wherein the emulsifier is a non-ionic emulsifier and comprises the addition product of ethylene oxide or propylene oxide and a carboxylic acid amide with 9 to 21 carbon atoms.

U.S. Pat. No. 6,312,481 to Lin et al., issued on Nov. 6, 2001, discloses the use of monoamide-containing polyether alcohol compounds as additives in fuel compositions and the use of these compounds to decrease intake valve deposits, control octane requirement increase, and reduce octane requirement.

The preparation of alkylene oxide-adducted hydrocarbyl amides may be carried out by methods familiar to one skilled in the art. For example, one may begin by reacting a fatty acid ester with a mono- or di-hydroxy hydrocarbyl amine to first yield a hydroxylated fatty acid amide as an intermediate reaction product. The alkylene oxide-adducted hydrocarbyl amide can then be obtained by further reaction of the intermediate with an alkylene oxide, such as ethylene oxide or propylene oxide. However, during the course of the reaction, low molecular weight by-products, particularly amine by-products, e.g. alkoxylated amines, such as propoxylated diethanolamines, are produced that are counter beneficial to the desired properties of the alkylene oxide-adducted hydrocarbyl amide when employed as a fuel additive. Such amine by-products are polar, basic and water soluble, resulting in the tendency to accumulate in the water bottoms of fuel storage tanks and on metal surfaces. Fuel tank water bottoms are notorious for harboring numerous accumulated compounds. Under the right conditions, certain low molecular weight amines may react with certain other compounds present, e.g. acidic corrosion inhibitors, possibly forming salts or gums which could potentially form deposits within the distribution system, e.g. filters, flow meters, etc. Within an internal combustion engine, there may be interactions between the amine by-products and other additive components in fuel compositions that could aggravate engine performance due to increased engine wear or sludge or varnish accumulation. Removal of amine by-products resulting from the preparation of alkylene oxide-adducted hydrocarbyl amides is complicated because of the propensity of these materials to form emulsions with aqueous extractions. Thus, it is highly desirable to minimize amine by-products from fuel additive packages containing alkylene oxide-adducted hydrocarbyl amides.

In addition, an important factor in engine no-harm performance is the compatibility of the fuel additive with the engine lubricating oil. Typically, a fraction of most fuel additives survives the combustion process intact and migrates past the piston rings into the crankcase. It is therefore very important that the additive not react negatively with the engine oil in ways that harm the oils functionality, e.g. sediment or cloud formation.

Commonly assigned copending U.S. patent application Ser. No. 10/993,344, filed Nov. 19, 2004, discloses a process for preparing alkylene oxide-adducted hydrocarbyl amides having very low residual levels of amine by-products, particularly alkoxylated amines such as propoxylated diethanolamines (PO-DEA). This process provides reduced levels of amine by-products down to less than 2 wt %.

SUMMARY OF THE INVENTION

The present invention provides a fuel composition comprising a major amount of hydrocarbons boiling in the gasoline or diesel range and an alkylene oxide-adducted hydrocarbyl amide reaction product having from 3 to 50, preferably 3 to 20, more preferably 4 to 15, moles of alkylene oxide per mole of hydrocarbyl amide, wherein the reaction product is prepared by (a) first reacting a fatty acid or fatty acid lower alkyl ester with ammonia or a mono- or di-hydroxy hydrocarbyl amine and (b) subsequently reacting the resulting intermediate with an alkylene oxide to provide a reaction product comprising the alkylene oxide-adducted hydrocarbyl amide, a mixture of mono- and di-ester products, and amine by-products, wherein the amount of amine by-products in the reaction product is less than 7 wt %, preferably less than 4 wt % and more preferably less than 2 wt %, based on the total weight of the alkylene oxide-adducted hydrocarbyl amide reaction product, and the amide to ester ratio in the reaction product is in the range of from about 0.1:1 to 1.1:1, preferably from about 0.3:1 to 0.9:1 and more preferably from about 0.5:1 to 0.7:1.

The alkylene oxide-adducted hydrocarbyl amide is typically derived from an alkyl or alkenyl amide having from about 4 to 30, preferably, about 6 to 24, carbon atoms.

The fatty acid is generally a $C_4$ to $C_{30}$, preferably a $C_6$ to $C_{24}$ and more preferably a $C_6$ to $C_{20}$ fatty acid. Most preferably the fatty acid is coconut oil fatty acid.

The lower alkyl group on the fatty acid lower alkyl ester has from about 1 to 6, preferably from about 1 to 4 and more preferably about 1 to 2 carbon atoms. Most preferably the lower alkyl ester of the fatty acid lower alkyl ester is a methyl ester.

The mono- or dihydroxy hydrocarbyl amine is preferably selected from the group consisting of ethanolamine, diethanolamine, propanolamine and dipropanolamine. More preferably, the di-hydroxy hydrocarbyl amine is diethanolamine.

Preferably, the alkyl or alkenyl amide is coconut oil fatty acid amide wherein the coconut oil fatty acid amide is obtained by the reaction of coconut oil fatty acid or ester and diethanolamine.

The alkylene oxide is preferably selected from the group consisting of ethylene oxide, propylene oxide, butylene oxide, pentylene oxide or mixtures thereof. More preferably, the alkylene oxide is selected form the group consisting of ethylene oxide, propylene oxide, or a mixture thereof.

Preferably, the alkylene oxide-adducted hydrocarbyl amide is derived from the reaction of a coconut oil fatty acid amide with ethylene oxide or propylene oxide. More preferably, the alkylene oxide-adducted hydrocarbyl amide is derived from the reaction of a coconut oil fatty acid amide with propylene oxide.

The alkylene oxide-adducted hydrocarbyl amide is generally present in the fuel in the range of from about 10 to 10,000, preferably about 10 to 5,000, more preferably about 10 to 1,000, and most preferably about 50 to 500 ppm by weight.

In another aspect, the present invention relates to a method of improving the demulsiblity and lubricating oil compatibility of a fuel composition in an internal combustion engine, which comprises operating the internal combustion engine with the fuel composition of the present invention.

Among other factors, the present invention is based on the discovery that amine by-products, e.g. alkoxylated amines such as propoxylated diethanolamines, and the amide to ester ratio resulting from the preparation of alkylene oxide-adducted hydrocarbyl amide reaction products greatly influence the performance of fuel compositions containing such alkylene oxide-adducted hydrocarbyl amide reaction products. Fuel compositions containing an alkylene oxide-adducted hydrocarbyl amide reaction product having less than 7 wt % amine by-products and an amide to ester ratio in the range of from about 0.1:1 to 1.1:1 in a gasoline or diesel fuel demonstrate no-harm properties such as demulsibility and reduced sediment formation. Such properties improve engine performance by enhancing the driveability of vehicles utilizing the alkylene oxide-adducted hydrocarbyl amide reaction products of the present invention as fuel additives in gasoline or diesel fuels.

DETAILED DESCRIPTION OF THE INVENTION

As stated above, the present invention relates to a fuel composition. In particular the fuel composition contains a major amount of hydrocarbons boiling in the gasoline or diesel range and an alkylene oxide-adducted hydrocarbyl amide reaction product, wherein the reaction product is prepared by (a) first reacting a fatty acid or fatty acid lower alkyl ester with ammonia or a mono- or di-hydroxy hydrocarbyl amine and (b) subsequently reacting the resulting intermediate with an alkylene oxide to provide a reaction product comprising the alkylene oxide-adducted hydrocarbyl amide, a mixture of mono- and di-ester products, and amine by-products. The reaction product has less than 7 wt % amine by-products, based on the total weight of the alkylene oxide-adducted hydrocarbyl amide reaction product, and the reaction product has an amide to ester ratio in the range of from about 0.1:1 to 1.1:1.

Prior to discussing the present invention in detail, the following terms will have the following meanings unless expressly stated to the contrary.

DEFINITIONS

The term "amino" refers to the group: —$NH_2$.

The term "hydrocarbyl" refers to an organic radical primarily composed of carbon and hydrogen which may be aliphatic, alicyclic, aromatic or combinations thereof, e.g., aralkyl or alkaryl. Such hydrocarbyl groups may also contain aliphatic unsaturation, i.e., olefinic or acetylenic unsaturation, and may contain minor amounts of heteroatoms, such as oxygen or nitrogen, or halogens, such as chlorine. When used in conjunction with carboxylic fatty acids, hydrocarbyl will also include olefinic unsaturation.

The term "alkyl" refers to both straight- and branched-chain alkyl groups.

The term "lower alkyl" refers to alkyl groups having 1 to about 6 carbon atoms and includes primary, secondary and tertiary alkyl groups. Typical lower alkyl groups include, for example, methyl, ethyl, n-propyl, isopropyl, n-butyl, sec-butyl, t-butyl, n-pentyl, n-hexyl and the like.

The term "alkenyl" refers to an alkyl group with unsaturation.

The term "alkylene oxide" refers to a compound having the formula:

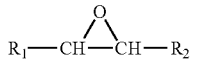

wherein $R_1$ and $R_2$ are each independently hydrogen or lower alkyl having from 1 to about 6 carbon atoms.

The Alkylene Oxide-Adducted Hydrocarbyl Amide

The present invention relates to a fuel composition containing an alkylene oxide-adducted hydrocarbyl amide reaction product prepared by (a) first reacting a fatty acid or fatty acid lower alkyl ester with ammonia or a mono- or di-hydroxy hydrocarbyl amine and (b) subsequently reacting the resulting intermediate with an alkylene oxide to provide a reaction product comprising the alkylene oxide-adducted hydrocarbyl amide, a mixture of mono- and di-ester products, and amine by-products. The reaction product has less than 7 wt % amine by-products, particularly alkoxylated amines such as propoxylated diethanolamines, and an amide to ester ratio in the reaction product in the range of from about 0.1:1 to 1.1:1.

The alkylene oxide-adducted hydrocarbyl amide will generally have the following structure:

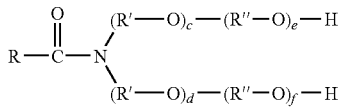

wherein,

- R is a hydrocarbyl group having from about 3 to 29, preferably from about 5 to 23, most preferably from about 5 to 19, carbon atoms;
- R' is a divalent alkylene group having from 1 to about 10, preferably from about 2 to 5, more preferably from about 2 to 3, carbon atoms;
- R" is a divalent alkylene group having from about 2 to 5, preferably from about 2 to 3, carbon atoms;
- c and d are independently 0 or 1, preferably both are 1; and
- e and f are independently integers from about 0 to 20, such that the total of e plus f ranges from about 3 to 40.

Preferably, the hydrocarbyl group, R, is alkyl or alkenyl, and more preferably, alkyl.

Preferably, e and f are independently integers from about 0 to 15, such that the total of e plus f ranges from about 3 to 30. More preferably, e and f are independently integers from about 0 to 10, such that the total of e plus f ranges from about 3 to 20.

The hydrocarbyl amide employed in the present invention, which is subsequently adducted with alkylene oxide, is typically the reaction product of a $C_4$ to $C_{30}$, preferably $C_6$ to $C_{24}$, more preferably $C_6$ to $C_{20}$, fatty acid or fatty acid lower alkyl ester, and ammonia, or a mono- or di-hydroxy hydrocarbyl amine, wherein the hydrocarbyl amide has the following structure:

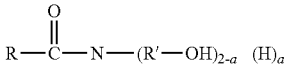

wherein R and R' are as defined above and a is an integer from about 0 to 2. Preferably, a is 0.

The acid moiety of the fatty acid or fatty acid lower alkyl ester may preferably be RCO— wherein R is preferably an alkyl or alkenyl hydrocarbon group containing about 5 to 19 carbon atoms typified by caprylic, caproic, capric, lauric, myristic, palmitic, stearic, oleic, linoleic, etc. Preferably the acid is saturated although unsaturated acid may be present.

Preferably, the reactant bearing the acid moiety may be natural oil such as coconut, babassu, palm kernel, palm, olive, castor, peanut, rape, beef tallow, lard, lard oil, whale blubber, sunflower, etc. Typically the oils which may be employed will contain several acid moieties, the number and type varying with the source of the oil.

The lower alkyl group of the fatty acid lower alkyl ester may be derived from a lower alkyl ester of a fatty acid. Preferred lower alkyl esters will have a lower alkyl group having from about 1 to 6, more preferably from about 1 to 4, most preferably from about 1 to 2, carbon atoms, e.g., methyl ester, ethyl ester, propyl ester, isopropyl ester, butyl ester, isobutyl ester, pentyl ester, isopentyl ester, and hexyl ester. Preferably, the lower alkyl ester is a methyl ester.

The acid moiety may be supplied in a fully esterified compound or one which is less than fully esterified, e.g., glyceryl tri-stearate, glyceryl di-laurate, glyceryl mono-oleate, etc. Esters of polyols, including diols and polyalkylene glycols may be employed such as esters of mannitol, sorbitol, pentaerythritol, polyoxyethylene polyol, etc.

Ammonia or a mono- or di-hydroxy hydrocarbyl amine with a primary or secondary amine nitrogen may be reacted to form the hydrocarbyl amides employed in the present invention. Typically, the mono- or di-hydroxy hydrocarbyl amines may be characterized by the formula:

$$HN(R'OH)_{2-b}H_b$$

wherein R' is as defined above and b is 0 or 1.

Typical amines may include, but are not limited to, ethanolamine, diethanolamine, propanolamine, isopropanolamine, dipropanolamine, di-isopropanolamine, butanolamines etc.

Reaction may be effected by heating the oil containing the acid moiety and the amine in equivalent quantities to produce the desired product. Reaction may typically be effected by maintaining the reactants at about 100° C. to 200° C., preferably about 120° C. to 150° C., for 1 to about 10 hours, preferably about 4 hours. Reaction may be carried out in a solvent, preferably one which is compatible with the ultimate composition in which the product is to be used.

Typical hydrocarbyl amide reaction products which may be employed in the practice of this invention may include those formed from esters having the following acid moieties and alkanolamines:

TABLE 1

| Acid Moiety in Ester | Amine |
|---|---|
| Lauric Acid | Propanolamine |
| Lauric Acid | Diethanolamine |
| Lauric Acid | Ethanolamine |
| Lauric Acid | Dipropanolamine |
| Palmitic Acid | Diethanolamine |
| Palmitic Acid | Ethanolamine |
| Stearic Acid | Diethanolamine |
| Stearic Acid | Ethanolamine |

Other useful mixed reaction products with alkanolamines may be formed from the acid component of the following oils: coconut, babassu, palm kernel, palm, olive, castor, peanut, rape, beef tallow, lard, whale blubber, corn, tall, cottonseed, etc.

In one aspect of the present invention, the desired reaction product may be prepared by the reaction of (i) a fatty acid ester of a polyhydroxy compound (wherein some or all of the OH groups are esterified) and (ii) diethanolamine.

Typical fatty acid esters may include esters of the fatty acids containing about 6 to 20, preferably about 8 to 18, more preferably about 12, carbon atoms. These acids may be characterized by the formula RCOOH wherein R is an alkyl hydrocarbon group containing about 7 to 17, preferably about 11 to 13, more preferably about 11 carbon atoms.

Typical of the fatty acid esters which may be employed may be glyceryl tri-laurate, glyceryl tri-stearate, glyceryl tri-palmitate, glyceryl di-laurate, glyceryl mono-stearate, ethylene glycol di-laurate, pentaerythritol tetra-stearate, pentaerythritol tri-laurate, sorbitol mono-palmitate, sorbitol penta-stearate, propylene glycol mono-stearate.

In another aspect of this invention, the desired reaction product may be prepared by the reaction of (i) fatty acid lower alkyl ester and (ii) diethanolamine.

Typical fatty acid lower alkyl esters may include lower alkyl esters of the fatty acids wherein the lower alkyl group contains from about 1 to 6, preferably from about 1 to 4, more preferably from about 1 to 2, carbon atoms. Preferably, the lower alkyl ester is a methyl ester. The fatty acids may be characterized by the formula RCOOH wherein R is an alkyl hydrocarbon group containing from about 7 to 17, preferably from about 11 to 13, more preferably about 11 carbon atoms. Typical of the fatty acids which may be employed are laurate, myristate, palmitate and stearate.

The esters may include those wherein the acid moiety is a mixture as is typified by the following natural oils: coconut, babassu, palm kernel, palm, olive, caster, peanut, rape, beef tallow, lard (leaf), lard oil, whale blubber.

A preferred ester is coconut oil lower alkyl ester which contains the following acid moieties:

TABLE 2

| Fatty Acid Moiety | Wt. % |
|---|---|
| Caprylic | 8.0 |
| Capric | 7.0 |
| Lauric | 48.0 |
| Myristic | 17.5 |
| Palmitic | 8.2 |
| Stearic | 2.0 |
| Oleic | 6.0 |
| Linoleic | 2.5 |

The alkylene-oxide-adducted hydrocarbyl amide employed in the present invention is preferably derived from an alkyl amide having from about 4 to 30, preferably from about 6 to 24, carbon atoms or alkenyl amide with at least one or two points of unsaturation having from about 4 to 30, preferably from about 6 to 24, carbon atoms. Examples of desirable alkyl amides suitable for the present invention include, but are not limited to, octyl amide (capryl amide), nonyl amide, decyl amide (caprin amide), undecyl amide dodecyl amide (lauryl amide), tridecyl amide, teradecyl amide (myristyl amide), pentadecyl amide, hexadecyl amide (palmityl amide), heptadecyl amide, octadecyl amide (stearyl amide), nonadecyl amide, eicosyl amide (alkyl amide), or docosyl amide (behenyl amide). Examples of desirable alkenyl amides include, but are not limited to, palmitoolein amide, oleyl amide, isooleyl amide, elaidyl amide, linolyl amide, linoleyl amide. Preferably, the alkyl or alkenyl amide is a coconut oil fatty acid amide.

The preparation of hydrocarbyl amides from fatty acid esters and alkanolamines is described, for example, in U.S. Pat. No. 4,729,769 to Schlicht et al., the disclosure of which is incorporated herein by reference.

The alkylene oxide which is adducted to the hydrocarbyl amide is derived from an alkylene group having from about 2 to 5 carbon atoms. Preferably, the alkylene oxide is selected from the group consisting of ethylene oxide, propylene oxide, butylene oxide, and pentylene oxide. Ethylene oxide and propylene oxide are particularly preferred. In addition, mixtures of alkylene oxides are desirable in which, for example, a mixture of ethylene oxide and propylene oxide may be used to form the alkylene oxide-adducted hydrocarbyl amide of the present invention. A respective molar ratio of from about 1:5 to 5:1 may be used in the case of a mixture of ethylene oxide and propylene oxide.

A desirable number of moles of the alkylene oxide to be adducted to the hydrocarbyl amide will be in the range of from about 3 to 50 moles of alkylene oxide per 1 mole of hydrocarbyl amide. More preferably, the range of from about 3 to 20 moles is particularly desirable. Most preferably, the range of from about 4 to 15 moles is most preferable as a molar range of the alkylene oxide per mole of hydrocarbyl amide.

Preferably, the alkylene oxide-adducted hydrocarbyl amide is derived from an alkylene oxide-adduction reaction involving a coconut oil fatty acid amide with ethylene oxide and/or propylene oxide. However, the alkylene oxide adducted hydrocarbyl amides useful as fuel additives in the present invention can be also a mixed product wherein various types and different moles of alkylene oxide can be adducted to various types of hydrocarbyl amides.

The alkylene oxide-adducted hydrocarbyl amide reaction product employed in the present invention will generally have less than 7 wt % amine by-products, particularly alkoxylated amines such as propoxylated diethanolamines. A general process for preparing an alkylene oxide-adducted hydrocarbyl amide having less than 7 wt % amine by-products is briefly described hereinbelow.

In the course of the reactions described above, various amine by-products may be formed that may have an adverse affect on fuel distribution systems and engine performance as discussed in the background above. These amine by-products may be in the form of diethanolamine or alkoxylated diethanolamine or mixtures thereof. A particular concern is propoxylated diethanolamine. The amine-by-products may be effectively removed by extraction with water, acidic water, or water containing inorganic salts or a combination thereof. Preferably, the inorganic salts may contain sodium, lithium, potassium, bromine, chlorine, iodine, acetate, ammonium and sulfate; more preferably, sodium, potassium, chlorine, ammonium, and sulfate; and most preferably, sodium chloride. This extraction procedure is more effective than using filtration through acidic solid supports such as acidic alumina, silica gel, or magnesium silicate (Florisil®, Magnesol®). Preferably, the process will utilize extraction with water, water containing inorganic salts, or a combination thereof. The effectiveness of the extraction is influenced by the number of washes, quantity of extractants, i.e., water or water containing inorganic salts, used with each wash, temperature, length of extraction, etc. Typically, the alkylene oxide-adducted hydrocarbyl amide reaction product will be extracted with a water/sodium chloride solution at a temperature ranging from about 5° C. to 95° C., preferably from about 5° C. to 50° C., more preferably from about 5° C. to 30° C. for a time ranging from about 10 to 120 minutes. The final alkylene oxide-adducted hydrocarbyl amide reaction product obtained after this extraction step will typically have less than 7 wt %, preferably less than 4 wt %, more preferably less than 2 wt %, of amine by-products, particularly alkoxylated amines such as propoxylated diethanolamines.

Furthermore, other by-products resulting from the preparation of the alkylene oxide-adducted hydrocarbyl amide will include various mono- and diesters, including their oxide-adducted derivatives. These other by-products are formed by the concurrent transesterification and amidation reactions occurring in the course of preparing the alkylene oxide-adducted hydrocarbyl amide.

In accordance with the present invention, the alkylene oxide-adducted hydrocarbyl amide reaction product has an amide to ester ratio in the range of from about 0.1:1 to 1.1:1, preferably in the range of from about 0.3:1 to 0.9:1 and more preferably in the range of from about 0.5:1 to 0.7:1 as determined, for example, by Fourier transform infrared spectrophotometry.

The amount of alkylene oxide-adducted hydrocarbyl amide added in a hydrocarbon-based fuel will typically be in a range of from about 10 to 10,000 ppm by weight per weight (active component ratio). Preferably, the desired range is from about 10 to 5,000 ppm by weight, more preferably a range of from about 10 to 1,000 ppm by weight and most preferably a range from about 50 to 500 ppm by weight, based on the total weight of the fuel composition.

Other Additives

The fuel composition of the present invention may also contain at least one nitrogen-containing detergent additive. Suitable detergent additives for use in this invention include, for example, aliphatic hydrocarbyl amines, hydrocarbyl-substituted poly(oxyalkylene)amines, hydrocarbyl-substituted succinimides, Mannich reaction products, nitro and amino aromatic esters of polyalkylphenoxyalkanols, polyalkylphenoxy-aminoalkanes, polyalkylpyrrolidines, and mixtures thereof.

The aliphatic hydrocarbyl-substituted amines which may be employed in the present invention are typically straight or branched chain hydrocarbyl-substituted amines having at least one basic nitrogen atom and wherein the hydrocarbyl group has a number average molecular weight of about 700 to 3,000. Preferred aliphatic hydrocarbyl-substituted amines include polyisobutenyl and polyisobutyl monoamines and polyamines.

The aliphatic hydrocarbyl amines employed in this invention are prepared by conventional procedures known in the art. Such aliphatic hydrocarbyl amines and their preparations are described in detail in U.S. Pat. Nos. 3,438,757; 3,565,804;

3,574,576; 3,848,056; 3,960,515; 4,832,702; and 6,203,584, the disclosures of which are incorporated herein by reference.

Another class of detergent additives suitable for use in the present invention are the hydrocarbyl-substituted poly(oxyalkylene)amines, also referred to as polyether amines. Typical hydrocarbyl-substituted poly(oxyalkylene)amines include hydrocarbyl poly(oxyalkylene)monoamines and polyamines wherein the hydrocarbyl group contains from 1 to about 30 carbon atoms, the number of oxyalkylene units will range from about 5 to 100, and the amine moiety is derived from ammonia, a primary alkyl or secondary dialkyl monoamine, or a polyamine having a terminal amino nitrogen atom. Preferably, the oxyalkylene moiety will be oxypropylene or oxybutylene or a mixture thereof. Such hydrocarbyl-substituted poly(oxyalkylene)amines are described, for example, in U.S. Pat. No. 6,217,624 to Morris et al., and U.S. Pat. No. 5,112,364 to Rath et al., the disclosures of which are incorporated herein by reference.

A preferred type of hydrocarbyl-substituted poly(oxyalkylene)monoamine is an alkylphenyl poly(oxyalkylene)monoamine wherein the poly(oxyalkylene) moiety contains oxypropylene units or oxybutylene units or mixtures of oxypropylene and oxybutylene units. Preferably, the alkyl group on the alkylphenyl moiety is a straight or branched-chain alkyl of 1 to about 24 carbon atoms. An especially preferred alkylphenyl moiety is tetrapropenylphenyl, that is, where the alkyl group is a branched-chain alkyl of about 12 carbon atoms derived from propylene tetramer.

An additional type of hydrocarbyl-substituted poly(oxyalkylene)amine finding use in the present invention are hydrocarbyl-substituted poly(oxyalkylene) aminocarbamates disclosed for example, in U.S. Pat. Nos. 4,288,612; 4,236,020; 4,160,648; 4,191,537; 4,270,930; 4,233,168; 4,197,409; 4,243,798 and 4,881,945, the disclosure of each of which are incorporated herein by reference.

These hydrocarbyl poly(oxyalkylene)aminocarbamates contain at least one basic nitrogen atom and have an average molecular weight of about 500 to 10,000, preferably about 500 to 5,000, and more preferably about 1,000 to 3,000. A preferred aminocarbamate is alkylphenyl poly(oxybutylene) aminocarbamate wherein the amine moiety is derived from ethylene diamine or diethylene triamine.

A further class of detergent additives suitable for use in the present invention are the hydrocarbyl-substituted succinimides. Typical hydrocarbyl-substituted succinimides include polyalkyl and polyalkenyl succinimides wherein the polyalkyl or polyalkenyl group has an average molecular weight of about 500 to 5,000, and preferably about 700 to 3,000. The hydrocarbyl-substituted succinimides are typically prepared by reacting a hydrocarbyl-substituted succinic anhydride with an amine or polyamine having at least one reactive hydrogen bonded to an amine nitrogen atom. Preferred hydrocarbyl-substituted succinimides include polyisobutenyl and polyisobutanyl succinimides, and derivatives thereof.

The hydrocarbyl-substituted succinimides finding use in the present invention are described, for example, in U.S. Pat. Nos. 5,393,309; 5,588,973; 5,620,486; 5,916,825; 5,954,843; 5,993,497; and 6,114,542, and British Patent No. 1,486,144, the disclosure of each of which are incorporated herein by reference.

Yet another class of detergent additives which may be employed in the present invention is Mannich reaction products which are typically obtained from the Mannich condensation of a high molecular weight alkyl-substituted hydroxyaromatic compound, an amine containing at least one reactive hydrogen, and an aldehyde. The high molecular weight alkyl-substituted hydroxyaromatic compounds are preferably polyalkylphenols, such as polypropylphenol and polybutylphenol, especially polyisobutylphenol, wherein the polyakyl group has an average molecular weight of about 600 to 3,000. The amine reactant is typically a polyamine, such as alkylene polyamines, especially ethylene or polyethylene polyamines, for example, ethylene diamine, diethylene triamine, triethylene tetramine, and the like. The aldehyde reactant is generally an aliphatic aldehyde, such as formaldehyde, including paraformaldehyde and formalin, and acetaldehyde. A preferred Mannich reaction product is obtained by condensing a polyisobutylphenol with formaldehyde and diethylene triamine, wherein the polyisobutyl group has an average molecular weight of about 1,000.

The Mannich reaction products suitable for use in the present invention are described, for example, in U.S. Pat. Nos. 4,231,759 and 5,697,988, the disclosures of each of which are incorporated herein by reference.

A still further class of detergent additive suitable for use in the present invention are polyalkylphenoxyaminoalkanes. Preferred polyalkylphenoxyaminoalkanes include those having the formula:

(III)

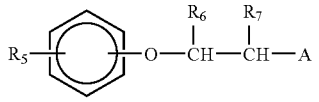

wherein:

$R_5$ is a polyalkyl group having an average molecular weight in the range of about 600 to 5,000;

$R_6$ and $R_7$ are independently hydrogen or lower alkyl having 1 to about 6 carbon atoms; and A is amino, N-alkyl amino having 1 to about 20 carbon atoms in the alkyl group, N,N-dialkyl amino having 1 to about 20 carbon atoms in each alkyl group, or a polyamine moiety having about 2 to 12 amine nitrogen atoms and about 2 to 40 carbon atoms.

The polyalkylphenoxyaminoalkanes of Formula III above and their preparations are described in detail in U.S. Pat. No. 5,669,939, the disclosure of which is incorporated herein by reference.

Mixtures of polyalkylphenoxyaminoalkanes and poly(oxyalkylene)amines are also suitable for use in the present invention. These mixtures are described in detail in U.S. Pat. No. 5,851,242, the disclosure of which is incorporated herein by reference.

A preferred class of detergent additive finding use in the present invention are nitro and amino aromatic esters of polyalkylphenoxyalkanols. Preferred nitro and amino aromatic esters of polyalkylphenoxyalkanols include those having the formula:

(IV)

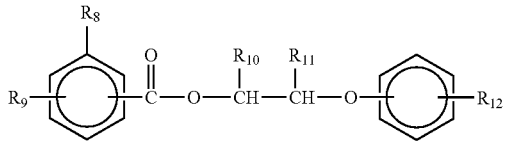

wherein:

$R_8$ is nitro or —$(CH_2)_n$—$NR_{13}R_{14}$, wherein $R_{13}$ and $R_{14}$ are independently hydrogen or lower alkyl having 1 to about 6 carbon atoms and n is 0 or 1;

$R_9$ is hydrogen, hydroxy, nitro or —$NR_{15}R_{16}$, wherein $R_{15}$ and $R_{16}$ are independently hydrogen or lower alkyl having 1 to about 6 carbon atoms;

$R_{10}$ and $R_{11}$ are independently hydrogen or lower alkyl having 1 to about 6 carbon atoms; and $R_{12}$ is a polyalkyl group having an average molecular weight in the range of about 450 to 5,000.

The aromatic esters of polyalkylphenoxyalkanols shown in Formula IV above and their preparations are described in detail in U.S. Pat. No. 5,618,320, the disclosure of which is incorporated herein by reference.

Mixtures of nitro and amino aromatic esters of polyalkylphenoxyalkanols and hydrocarbyl-substituted poly(oxyalkylene)amines are also preferably contemplated for use in the present invention. These mixtures are described in detail in U.S. Pat. No. 5,749,929, the disclosure of which is incorporated herein by reference.

Preferred hydrocarbyl-substituted poly(oxyalkylene) amines which may be employed as detergent additives in the present invention include those having the formula:

(V)

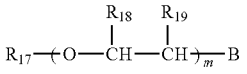

wherein:

$R_{17}$ is a hydrocarbyl group having from 1 to about 30 carbon atoms;

$R_{18}$ and $R_{19}$ are each independently hydrogen or lower alkyl having about 1 to about 6 carbon atoms and each $R_{18}$ and $R_{19}$ is independently selected in each —O—$CHR_{18}$—$CHR_{19}$— unit;

B is amino, N-alkyl amino having 1 to about 20 carbon atoms in the alkyl group, N,N-dialkyl amino having 1 to about 20 carbon atoms in each alkyl group, or a polyamine moiety having about 2 to 12 amine nitrogen atoms and about 2 to 40 carbon atoms; and m is an integer from about 5 to 100.

The hydrocarbyl-substituted poly(oxyalkylene)amines of Formula V above and their preparations are described in detail in U.S. Pat. No. 6,217,624, the disclosure of which is incorporated herein by reference.

The hydrocarbyl-substituted poly(oxyalkylene)amines of Formula V are preferably utilized either by themselves or in combination with other detergent additives, particularly with the polyalkylphenoxyaminoalkanes of Formula III or the nitro and amino aromatic esters of polyalkylphenoxyalkanols shown in Formula IV. More preferably, the detergent additives employed in the present invention will be combinations of the hydrocarbyl-substituted poly(oxyalkylene)amines of Formula V with the nitro and amino aromatic esters of polyalkylphenoxyalkanols shown in Formula IV. A particularly preferred hydrocarbyl-substituted poly(oxyalkylene)amine detergent additive is dodecylphenoxy poly(oxybutylene)amine and a particularly preferred combination of detergent additives is the combination of dodecylphenoxy poly(oxybutylene)amine and 4-polyisobutylphenoxyethyl para-aminobenzoate.

Another type of detergent additive suitable for use in the present invention are the nitrogen-containing carburetor/injector detergents. The carburetor/injector detergent additives are typically relatively low molecular weight compounds having a number average molecular weight of about 100 to 600 and possessing at least one polar moiety and at least one non-polar moiety. The non-polar moiety is typically a linear or branched-chain alkyl or alkenyl group having about 6 to 40 carbon atoms. The polar moiety is typically nitrogen-containing. Typical nitrogen-containing polar moieties include amines (for example, as described in U.S. Pat. No. 5,139,534 and PCT International Publication No. WO 90/10051), ether amines (for example, as described in U.S. Pat. No. 3,849,083 and PCT International Publication No. WO 90/10051), amides, polyamides and amide-esters (for example, as described in U.S. Pat. Nos. 2,622,018; 4,729,769; and 5,139,534; and European Patent Publication No. 149,486), imidazolines (for example, as described in U.S. Pat. No. 4,518,782), amine oxides (for example, as described in U.S. Pat. Nos. 4,810,263 and 4,836,829), hydroxyamines (for example, as described in U.S. Pat. No. 4,409,000), and succinimides (for example, as described in U.S. Pat. No. 4,292,046).

Still other detergent additives useful in the present invention are polyalkylpyrrolidines, as described in U.S. Pat. No. 6,033,446, the disclosure of which is incorporated herein by reference, having the following formula:

(I)

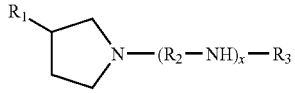

or a fuel-soluble salt thereof;

wherein $R_1$ is a polyalkyl group having an average molecular weight in the range of from about 500 to 5,000;

$R_2$ is a straight- or branched-chain alkylene group having from about 2 to 6 carbon atoms;

$R_3$ is H or $CH_3$; and x is an integer from 0 to about 4.

Preferably, $R_1$ is a polyalkyl group having an average molecular weight in the range of from about 500 to 3,000, more preferably from about 700 to 2,000, and most preferably from about 700 to 1,500.

In addition, $R_1$ is preferably a polyalkyl group derived from polypropylene, polybutene, or polyalphaolefin oligomers of 1-octene or 1-decene. More preferably, $R_1$ is a polyalkyl group derived from polyisobutene. Most preferably, $R_1$ is a polyalkyl group derived from a highly reactive polyisobutene containing at least about 20% of a methylvinylidene isomer.

Preferably, $R_2$ is a straight- or branched-chain alkylene group having from about 2 to 4 carbon atoms. Most preferably, $R_2$ contains about 2 or 3 carbon atoms.

Preferably, $R_3$ is H.

Preferably, x is an integer of from 0 to about 2. Most preferably, x is 0.

The fuel additive composition of the present invention can also be combined with one, two, or more other additives known to be used in hydrocarbon-based fuels. Such additives include, but are not limited to, deposit control additives such as detergents or dispersants, corrosion inhibitors, oxidation inhibitors, metal deactivators, demulsifiers, static electricity preventing agents, anti-coagulation agents, anti-knock agents, oxygenates, flow improvers, pour point depressants, cetane improvers and auxiliary-solution agents.

Diesel fuels will typically contain various additives in conventional amounts. The additives include cold flow improvers, pour point depressants, storage stabilizers, corrosion inhibitors, anti-static agents, biocidal additives, combustion modifiers or smoke suppressants, dyes, and deodorants. Examples of such additives are known to the art as well as to the literature. Accordingly, only a few additives will be discussed in detail. Considering the storage stabilizers, they can include various antioxidants which prevent the accumulation of organic peroxides such as hindered phenols, N,N,-dialkyl paraphenylene diamines, para-amino phenols and the like. Color stabilizers constitute another group with specific examples including tertiary amines, secondary amines, imidazolines, tertiary alkyl primary amines, and the like. Another storage stabilizer group are the various metal deactivators for metals which serve as catalysts for oxidation during storage. Yet other storage stabilizers are the various dispersants which keep gummy, insoluble residues and other solids dispersed as small particles so that they do not interfere with the proper burning of the fuel. Such compounds can be oil soluble ethoxylated alkyl phenols, polyisobutylene alkylated succinimides, polyglycol esters of alkylated succinic anhydrides, and the like.

Considering the corrosion inhibitors which generally retard the effects of oxygen and/or water, they are generally polar organic molecules which form a monomolecular protective layer over metal surfaces. Chemically, such corrosion inhibitors fall into three general classes: (1) complex carboxylic acids or their salts, (2) organic phosphorus acids and their salts, and (3) ammonium mahogany sulfonates.

Combustion modifiers for diesel fuel have been found to suppress the formation of black smoke, that is, unburned carbon particles, in the diesel engine. These additives are believed to not only catalyze the burning of carbon particles to $CO_2$, but also to suppress the formation of free carbon in the early stages of the combustion cycle. Generally, two different types of chemicals are effective in suppressing diesel smoke. The first type comprises barium and calcium salts in amine or sulfonate complexes while the other type consists of metal alkyls of transition elements such as manganese, iron, cobalt, nickel, and the like.

Amounts of the various fuel additives in the fuel can vary over a considerable range. Generally, a suitable amount of a diesel fuel stabilizer is from about 3 to about 300 ppm. A suitable amount of a corrosion inhibitor is from about 1 to about 100 ppm with a suitable amount of a smoke suppressant being from about 100 to about 5,000 ppm. Naturally, higher or lower amounts can be utilized depending upon the type of fuel, the type of diesel engine, and the like.

Diesel fuels may also contain various sulfur-free and sulfur-containing cetane improvers. Desirably, the sulfur-free compounds are nitrate cetane improvers which are known to the art as well as to the literature. For example, a description of such nitrate cetane improvers are set forth in U.S. Pat. Nos. 2,493,284; 4,398,505; 2,226,298; 2,877,749; 3,380,815; an article "Means of Improving Ignition Quality of Diesel Fuels" by Nygarrd et al, J. Inst. Petroleum, 27, 348-368 (1941); an article "Preflame Reactions in Diesel Engines", Part 1, by Gardner et al, The Institute of Petroleum, Vol. 38, 341, May, 1952; and an article "Ignition Accelerators for Compression-Ignition Fuels" by Bogen et al, Petroleum Refiner 23, (7) 118-52 (1944), which are hereby fully incorporated by reference with regard to various types of nitrate cetane improvers. Generally, the cetane improvers are alkyl nitrates having from about 1 to about 18 carbon atoms and desirably from about 2 to about 13 carbon atoms. Examples of specific nitrate cetane improvers include ethyl nitrate, butyl nitrate, amyl nitrate, 2-ethylhexyl nitrate, polyglycol dinitrate, and the like. Amyl nitrate and 2-ethylhexyl nitrate are preferred. Sulfur-containing cetane improvers are described, for example, in U.S. Pat. No. 4,943,303. Combinations of sulfur-containing cetane improvers with sulfur-free cetane improvers, such as nitrate cetane improvers, may also be employed in diesel fuels.

A fuel-soluble, nonvolatile carrier fluid or oil may also be used with the alkylene oxide-adducted hydrocarbyl amide reaction products employed in the present invention. The carrier fluid is a chemically inert hydrocarbon-soluble liquid vehicle which substantially increases the nonvolatile residue (NVR), or solvent-free liquid fraction of the fuel composition while not overwhelmingly contributing to octane requirement increase. The carrier fluid may be a natural or synthetic oil, such as mineral oil, refined petroleum oils, synthetic polyalkanes and alkenes, including hydrogenated and unhydrogenated polyalphaolefins, synthetic polyoxyalkylene-derived oils, such as those described, for example, in U.S. Pat. No. 4,191,537 to Lewis, and polyesters, such as those described, for example, in U.S. Pat. Nos. 3,756,793 and 5,004,478 to Robinson and Vogel et al., respectively, and in European Pat. Application Nos. 356,726 and 382,159, published Mar. 7, 1990 and Aug. 16, 1990, respectively.

EXAMPLES

The invention will be further illustrated by the following examples, which set forth particularly advantageous method embodiments. While the Examples are provided to illustrate the present invention, they are not intended to limit it.

Example 1

The following example illustrates a typical process for preparing the alkylene oxide-adducted hydrocarbyl amides of the present invention having less than 7 wt % amine byproducts and an amide:ester in the range of from about 0.1:1 to 1.1:1.

1a. Preparation of Cocoamide-DEA

To a flask equipped with a mechanical stirrer and thermometer was added 2000 grams (g) of methyl cocoate, i.e. methyl ester of coconut oil, with less than 0.05 wt % glycerol. Then 926 g of diethanolamine (DEA) was added. The mixture was heated to about 150° C. for about 4 hours. At the end of the reaction time, the mixture is cooled to about 95° C. and stripped under vacuum at about 450 mm Hg to remove methanol. The DEA content of the product was less than 2.0 wt %.

1b. Preparation of Propoxylated Cocoamide-DEA

In a typical preparation of propoxylated cocoamide-DEA, 2000 g of cocoamide-DEA from Example 1a is charged to an autoclave equipped with stirrer and hot oil cooling jacket. Then 37 g of potassium hydroxide is added. The autoclave is heated to about 120° C. and vacuum of less than 30 mm Hg is applied to remove the water formed. After bringing the autoclave to atmospheric pressure with nitrogen, 1548 g of propylene oxide is added over about 4 hours. The reaction is completed about 6 hours after the propylene oxide is finished charging. The autoclave is cooled to about 95° C. and the catalyst is removed by treating with Florisil, water and filter aid. The mixture is filtered on a Buchner funnel. The product will typically contain from about 2 to 25 wt % propoxylated-DEA (PO-DEA) when determined by gas chromatography.

Example 2

To a flask equipped with a mechanical stirrer and thermometer was added 200 g of propoxylated cocoamide-DEA prepared in a manner similar to the procedure described in Example 1 and having a PO-DEA content of about 23.2 wt % and 110 g of toluene. To the mixture was added 200 g of water at about 80° C. and 26.8 g of saturated sodium chloride solution. After mixing for 30 minutes at about 80° C., the mixing was stopped. The phases were allowed to separate for 30 minutes. The bottom aqueous phase was removed. The organic phase was washed with water and saturated sodium chloride one more time and phases separated. The second aqueous phase was removed and combined with the first aqueous phase. The organic phase was rotary evaporated at about 95-100° C. under vacuum of <30 mm Hg for 30 minutes or until all of the toluene and water in the organic phase was removed. The stripped product was weighed and analyzed. The water soluble fraction into the aqueous phase was also extracted with ethyl acetate using a liquid/liquid extraction apparatus. The PO-DEA content was effectively reduced from about 23.2 wt % to about 1.6 wt % as determined by gas chromatography. On the basis of Fourier transform infrared spectrophotmetry (FT-IR), the amide:ester ratio was determined to be about 0.62:1.

Example 3

To a flask equipped with a mechanical stirrer and thermometer was added 200 g of propoxylated cocoamide-DEA preferred in a manner similar to the procedure described in Example 1 and having a PO-DEA content of about 23.2 wt %, 200 g of water and 26.8 g of saturated sodium-chloride solution. After mixing for 30 minutes at 20-30° C., the mixing was stopped. The phases were allowed to separate 30 minutes. The bottom aqueous phase was removed. The top organic layer was washed with water and saturated sodium chloride one more time and phase separated. The organic phase was rotary evaporated at about 95-100° C. under vacuum of <30 mm Hg for 30 minutes. The stripped product was weighed and analyzed by gas chromatography. The PO-DEA content was effectively reduced from about 23.2 wt % to about 1.4 wt %. By FT-IR analysis, the amide:ester ratio was about 0.62:1.

Example 4

The procedure of Example 4 was performed as described in Example 2 except no NaCl was used. Propoxylated cocoamide-DEA with 2.8 wt % PO-DEA was water washed. However, the water washing was done with solvent but without NaCl. The PO-DEA content was effectively reduced from 2.8 wt % to 1.0 wt %. By FT-IR analysis, the amide:ester ratio was about 1.1:1.

Example 5

The procedure of Example 5 was performed as described in Example 2 but with no solvent and no NaCl. The PO-DEA content was effectively reduced from 2.8 wt % to 0.9 wt %. By FT-IR analysis, the amide:ester ratio was about 1.1:1.

Example 6

Demulsibility Test

Whenever surface active additives are blended into the fuel, care must be taken to ensure sufficient water shedding ability (demulsibility). Reasons for this are primarily to prevent a hazing or milky appearance, symptomatic of the formation of emulsions. These emulsions can clog filters. In addition, they can carry undesirable components picked up from the distribution system into a vehicle tank. For this reason, tests are performed to ensure that the finished fuel passes certain demulsibility requirements. Additional additives may be formulated to improve demulsibility, but these incur extra costs.

The demulsibility of a propylene oxide-adducted cocoamide-DEA having less than 1.9 wt % PO-DEA (Batch 2) was compared with another batch having 19.3 wt % PO-DEA (Batch 1) using a modified ASTM D1094 method which measures the presence of water-soluble components in gasoline and the effect of these components on volume change and on the fuel-water interface. Using this technique reveals the presence of water-soluble components such as amines. Contaminants that affect the interface are apt to disarm filter-separators quickly and allow free water and particulates to pass.

Briefly, a sample is shaken with an aqueous buffer solution in a clean glass cylinder at ambient temperature and then allowed to stand to let the mixture separate into hydrocarbon and aqueous phases. After five minutes of standing, the change in volume of the aqueous layer is measured. The appearance of the hydrocarbon/aqueous interface also is examined for the presence of bubbles or film. The standard specifies only buffered water to pH7 for the demulsibility (or water shedding) tests. However, the demulsibility test was expanded to include additional water compositions, mimicking a range of water properties typically found in manufacturing or distribution systems, i.e., pH4, pH7, pH10, and simulated sea water. These tests were run using a commercial polyether amine-based deposit control additive and a commercial base gasoline blended with 15% of methyl tertiary-butyl ether. It is important to note that if there is a failure in any of the specially prepared water mixtures that test fails.

Demulsibility or the ability of a fuel to shed water completely is a critical property from both an aesthetic and a performance perspective. All fuel manufacturers require a base fuel that conforms to regulatory requirements (e.g., ASTM D 4814, Annex A1, water tolerance specifications for base gasoline sold into the US market) for brightness, clarity and haze. In addition, some fuel marketers will specify a rating of 1 in their finished fuels (base fuel plus additive or additives) in the ASTM D1094 test with respect to the fuel phase. A rating of 1 corresponds to a fuel which is bright and clear and is the strictest standard required by some fuel marketers.

However, more crucial than a fuel's appearance is the necessity of having a fuel free of water in order to prevent instigation of fuel system corrosion and deposit formation. It is for this reason that the second number in the ASTM D1094 test is of critical importance. This number relates to the condition of the fuel/water interface. Given time, a stagnant water layer sitting at the bottom of a tank, can become enriched in polar molecules from the fuel itself. Eventually this will lead to the stagnant water layer having the ability to form a stable emulsion with the fuel itself. This can lead to both water, and when present, water-soluble contaminants such as caustic and inorganic salts, being carried throughout the fuel distribution system leading to corrosion and deposit formation. A fuel which has an interface layer with shreds of cloudy lace is evidence of fuel and water co-mingling. An interface which is clean and clear will not allow for the exchange of polar fuel molecules into the aqueous layer. Clean and clear interface's also enable the aqueous layer to be removed or drained away cleanly. It is for this reason that manufacturers will mandate a rating of 1b to 2 per the ASTM D1094 test for the fuel/water interface.

Results of the ASTM D1094 Test are presented below in Table 3.

TABLE 3

| | PO-DEA | pH4 | | | pH7 | | | pH10 | | | Sea Water | | |
|---|---|---|---|---|---|---|---|---|---|---|---|---|---|
| Batch | wt % | F | I | S | F | I | S | F | I | S | F | I | S |
| none | — | 1 | 1b | 1 | 1 | 1 | 1 | 1 | 1 | 1 | 1 | 1b | 1 |
| 1 | 19.3 | 4 | 1 | 2 | 1 | 1 | 1 | 1 | 3 | 1 | 1 | 1b | 1 |
| 2 | 1.9 | 1 | 1 | | 1 | 1 | | 1 | 1 | | 1 | 1 | |

Abbreviations:
F = Fuel Phase
I = Interface
S = Separation
Explanation of Rating Scales:
Fuel Phase:
1 = bright and clear
2 = Slight haze
3 = Distinct haze
4 = Severe haze
5 = Opaque
Interface:
1 = Clean and clear
1b = A few small bubbles or "lace" covering 50% of the interfacial area
2 = Shreds of "lace" or bubbles >50%, <100% of area
3 = Loose lace - light scum over 100% of area but <1 ml
4 = Tight lace - heavy scum <3 ml
5 = Tight lace - heavy scum >3 ml
Separation:
1 = Complete absence of all emulsions and/or precipitates within fuel and/or water layer
1+ = Slight fuel haze
2 = Small air bubbles or water/fuel droplets in fuel or water layer or adhering to glass cylinder
3 = Emulsions and/or precipitates within fuel and/or water layer

Example 7

Engine Lube Oil Compatibility Test

Another important dimension of performance is the tendency to form sediment or sludge in the engine oil. When fuel additives are used it is common that a portion of the fuel will work its way into the crankcase oil. Often these additives have incompatibility with the engine oil, forming sediments and sludge.

An accelerated engine lube oil compatibility study, designed to differentiate sludge and varnish forming potential, was conducted with samples of the propylene oxide-adducted cocoamide-DEA having less than 4 wt % PO-DEA. The test involved mixing 2.5 wt % of the propylene oxide-adducted cocoamide-DEA additive into two different premium commercial 10W-30 engine lubricating oils [Pennzoil 10W-30 (Oil A) and Chevron 10W-30 (Oil B) oils]. The mixtures were heated to 150-160° F. for seven days and allowed to cool to room temperature. After this preconditioning, the mixtures were observed once per week for changes in the fluid phase and in the formation of sediments. The following Table 4 shows the results of this testing. The lower the numerical rating indicates the better result.

TABLE 4

| Batch | Wt % PO-DEA | Amide/Ester Ratio | Oil | Sediment Rating |
|---|---|---|---|---|
| A | 1.9 | 1.2 | Oil A | 2 |
| B | 0.2 | 1.8 | Oil A | 2 |
| C | 0.8 | 1.5 | Oil A | 2 |
| A | 1.9 | 1.2 | Oil B | 2 |

TABLE 4-continued

| Batch | Wt % PO-DEA | Amide/Ester Ratio | Oil | Sediment Rating |
|---|---|---|---|---|
| B | 0.2 | 1.8 | Oil B | 2 |
| C | 0.8 | 1.5 | Oil B | 2 |
| D | 2.1 | 0.64 | Oil A | 1 |
| D | 2.1 | 0.64 | Oil B | 1 |

Sediment Rating:
0 = No sediment
1 = very slight sediment
2 = slight sediment
3 = heavy sediment
4 = appreciably more sediment than 3
Oil A = Pennzoil 10W 30, SJ/SL API Service Category
Oil B = Chevron 10W 30, SJ/SL API Service Category These results show that a propylene oxide-adducted cocoamide-DEA having an amide to ester ratio of 0.64, together with 2.1 wt % PO-DEA, yields less sediment and sludge formation, when compared with compositions having a higher amide to ester ratio.

What is claimed is:

1. A fuel composition comprising a major amount of hydrocarbons boiling in the gasoline or diesel range and an extracted alkylene oxide-adducted hydrocarbyl amide reaction product comprising an alkylene oxide-adducted hydrocarbyl amide having from about 3 to 50 moles of alkylene oxide per mole of hydrocarbyl amide, a mixture of mono- and di-ester products, and amine by-products, wherein the extracted reaction product is prepared by (a) first reacting a fatty acid or fatty acid lower alkyl ester with ammonia or a mono- or di-hydroxy hydrocarbyl amine and (b) subsequently reacting the resulting intermediate with an alkylene oxide to provide an alkylene oxide-adducted hydrocarbyl amide reaction product, wherein the alkylene oxide-adducted hydrocarbyl amide reaction product obtained in step (b) is washed with an extractant to provide an extracted alkylene oxide-adducted hydrocarbyl amide reaction product and wherein the amount of amine by-products in the extracted reaction product is less than 4 wt %, based on the total weight of the extracted alkylene oxide-adducted hydrocarbyl amide reaction product, and the amide:ester ratio in the extracted reaction product is in the range of from about 0.1:1 to 1.1:1, and further comprising one or more fuel additives for hydrocarbon-based fuels.

2. The fuel composition according to claim 1, wherein the alkylene oxide-adducted hydrocarbyl amide has from about 3 to 20 moles of alkylene oxide per mole of hydrocarbyl amide.

3. The fuel composition according to claim 2, wherein the alkylene oxide-adducted hydrocarbyl amide has from about 4 to 15 moles of alkylene oxide per mole of hydrocarbyl amide.

4. The fuel composition according to claim 1, wherein the alkylene oxide-adducted hydrocarbyl amide is derived from an alkyl or alkenyl amide having from about 4 to 30 carbon atoms.

5. The fuel composition according to claim 4, wherein the alkylene oxide-adducted hydrocarbyl amide is derived from an alkyl or alkenyl amide having from about 6 to 24 carbon atoms.

6. The fuel composition according to claim 5, wherein the alkyl or alkenyl amide is a coconut oil fatty acid amide.

7. The fuel composition according to claim 6, wherein the coconut oil fatty acid amide is obtained by the reaction of coconut oil fatty acid or ester and diethanolamine.

8. The fuel composition according to claim 1, wherein the fatty acid is a $C_4$ to $C_{30}$ fatty acid.

9. The fuel composition according to claim 1, wherein the fatty acid is a $C_6$ to $C_{24}$ fatty acid.

10. The fuel composition according to claim 9, wherein the fatty acid is a $C_6$ to $C_{20}$ fatty acid.

11. The fuel composition according to claim 10, wherein the fatty acid is coconut oil fatty acid.

12. The fuel composition according to claim 1, wherein the lower alkyl group of the fatty acid lower alkyl ester has from about 1 to 6 carbon atoms.

13. The fuel composition according to claim 12, wherein the lower alkyl group of the fatty acid lower alkyl ester has from about 1 to 4 carbon atoms.

14. The fuel composition according to claim 13, wherein the lower alkyl group of the fatty acid lower alkyl ester has from about 1 to 2 carbon atoms.

15. The fuel composition according to claim 1, wherein the lower alkyl ester is a methyl ester.

16. The fuel composition according to claim 1, wherein the mono- or di-hydroxy hydrocarbyl amine is selected from the group consisting of ethanolamine, diethanolamine, propanolamine and dipropanolamine.

17. The fuel composition according to claim 16, wherein the hydrocarbyl amine is a di-hydroxy hydrocarbyl amine.

18. The fuel composition according to claim 17, wherein the di-hydroxyl hydrocarbyl amine is diethanolamine.

19. The fuel composition according to claim 1, wherein the alkylene oxide is selected from the group consisting of ethylene oxide, propylene oxide, butylene oxide, pentylene oxide, and mixtures thereof.

20. The fuel composition according to claim 1, wherein the alkylene oxide is selected from the group consisting of ethylene oxide, propylene oxide, and mixtures thereof.

21. The fuel composition according to claim 1, wherein the alkylene oxide-adducted hydrocarbyl amide is derived from the reaction of a coconut oil fatty acid amide with ethylene oxide or propylene oxide.

22. The fuel composition according to claim 1, wherein the alkylene oxide-adducted hydrocarbyl amide is derived from the reaction of a coconut oil fatty acid amide with propylene oxide.

23. The fuel composition according to claim 1, wherein the alkylene oxide-adducted hydrocarbyl amide is present in the fuel in the range of from about 10 to 10,000 ppm by weight.

24. The fuel composition according to claim 23, wherein the alkylene oxide-adducted hydrocarbyl amide is present in the fuel in the range of from about 10 to 5,000 ppm by weight.

25. The fuel composition according to claim 24, wherein the alkylene oxide-adducted hydrocarbyl amide is present in the fuel in the range of from about 10 to 1,000 ppm by weight.

26. The fuel composition according to claim 25, wherein the alkylene oxide-adducted hydrocarbyl amide is present in the fuel in the range of from about 50 to 500 ppm by weight.

27. The fuel composition according to claim 1, wherein the amine by-products are less than 2 wt %, based on the total weight of the extracted alkylene oxide-adducted hydrocarbyl amide reaction product.

28. The fuel composition according to claim 1, wherein the amine by-product is diethanolamine, alkoxylated diethanolamine or mixtures thereof.

29. The fuel composition according to claim 28, wherein the amine by-products is an alkoxylated diethanolamine.

30. The fuel composition according to claim 29, wherein the alkoxylated diethanolamine is propoxylated diethanolamine.

31. The fuel composition according to claim 1, wherein the amide to ester ratio is in the range of from about 0.3:1 to 0.9:1.

32. The fuel composition according to claim 31, wherein the amide to ester ratio is in the range of from about 0.5:1 to 0.7:1.

33. A method of improving the demulsibility and lubricating oil compatibility of a fuel composition in an internal combustion engine, said method comprising operating the internal combustion engine with the fuel composition of claim 1.

34. The fuel composition of claim 1, wherein the extractant is selected from the group consisting of water, acidic water, water containing inorganic salts and combinations thereof.

35. The fuel composition of claim 1, wherein the one or more fuel additives are selected from the group consisting of a detergent, dispersant, corrosion inhibitor, oxidation inhibitor, metal deactivator, demulsifier, static electricity preventing agent, anti-coagulation agent, anti-knock agent, oxygenate, flow improver, pour point depressant, cetane improver and auxiliary-solution agent.

* * * * *